US007536740B1

(12) United States Patent
Swartz

(10) Patent No.: US 7,536,740 B1
(45) Date of Patent: May 26, 2009

(54) RESTING MATTRESS

(76) Inventor: Jann E. Swartz, 2215 2nd Ave. North, Seattle, WA (US) 98109

( * ) Notice: Subject to any disclaimer, the term of this patent is extended or adjusted under 35 U.S.C. 154(b) by 0 days.

(21) Appl. No.: 12/101,979

(22) Filed: Apr. 12, 2008

(51) Int. Cl.
*A47C 27/10* (2006.01)

(52) U.S. Cl. ..... 5/710; 5/706; 5/644; 5/725; 5/630; 5/648; 5/633

(58) Field of Classification Search ..... 5/417, 5/419, 420, 706, 710, 655.3, 656, 725, 638, 5/731, 733–735, 723, 691, 630–632, 636, 5/621, 624, 644, 633, 648; 128/202.18
See application file for complete search history.

(56) References Cited

U.S. PATENT DOCUMENTS 4,723,329 A * 2/1988 Vaccaro ..... 5/710
4,788,730 A 12/1988 Bexton
4,878,258 A * 11/1989 Casey ..... 5/420
5,231,717 A * 8/1993 Scott et al. ..... 5/727
5,509,153 A 4/1996 Roschacher
D392,145 S * 3/1998 Thurston ..... D6/604
6,427,272 B1 * 8/2002 Yacoub ..... 5/638
6,959,464 B2 11/2005 Fahey
7,146,664 B1 * 12/2006 Grosvenor ..... 5/638

* cited by examiner

*Primary Examiner*—Patricia L Engle
*Assistant Examiner*—Nicholas Polito
(74) *Attorney, Agent, or Firm*—Crossley Patent Law; Mark A. Crossley

(57) ABSTRACT

An inflatable resting mattress designed for indoor and outdoor use, which allows a user to support his head within a facial aperture while lying in a prone position. The facial aperture includes several breathing tubes designed to allow a user to maintain normal breathing. Three support pillows are provided for a user to place under his head, lumbar and legs to support proper spine alignment while lying in a prone position. These pillows are adapted to secure to the body mat to prevent slippage.

9 Claims, 6 Drawing Sheets

RESTING MATTRESS

FIELD OF THE INVENTION

The present invention relates to pillow devices and, more specifically, to a self-contained resting mattress for both indoor and outdoor use, which allows the user to support his head and chest for added comfort. The main mattress has an indention for a users face when lying in a prone position and has removable inflatable pillows for lying on ones back.

BACKGROUND OF THE INVENTION

While a variety of pillows exist in the market today, none have the specific purpose of simultaneously giving neck and back support, while also allowing adjustment of the firmness. The present resting mattress fills that void. While lying in a supine position atop the resting mattress, the present device is equipped with a head support pillow, a lumbar support pillow and a leg support pillow for proper spinal alignment. The pillows are designed to adjust not only in firmness but also in placement. The placement of the pillows is determined by the user's comfort and size. Should a user desire to lie in a prone position the body mat is equipped with a facial aperture which has breathing tubes that allow continuous air flow.

SUMMARY OF THE INVENTION

The present resting mattress provides an inflatable body mat a head support pillow, a lumbar support pillow and leg support pillow. The inflatable body mat has a facial aperture designed to receive a user's face while they lie in a prone position. The facial aperture is cross-shaped and descends within the body mat ¾ of the body mat's overall thickness. At the bottom of the facial aperture are four breathing tubes designed to provide ample amounts of air for comfortable breathing. When a user lies in a supine position, the support pillows may be used to properly align the user's spine and maximize their resting experience. The support pillows are further designed to adjust not only in firmness but also placement. Not all users are the same height; the body mat is equipped with a plurality of securing fasteners design to connect to matting fasteners incorporated within the support pillows. The incorporation of both the securing and matting fasteners allow the pillows to be removably attached to the body mat in a variety of positions or stored in an attached position.

The present device is preferably constructed from durable heat-stamped vinyl, which allows for use in almost any condition. However, the pillows and mat may also be constructed from other durable, airtight materials even a semi-rigid gel. When used outdoors, the resting mattress gives support to the head and chest when lying in a prone position. This support allows the user to enjoy an added comfort giving a more relaxed outdoor experience. The resting mattress helps alleviate strain typically placed upon the neck and back muscles when lying in a prone position on the ground or sand. The use of the present device also allows the body of the user to be elevated off the ground keeping the user's face and front side out of the sand, dirt and grass and away from insects often embedded in the ground. The body mat allows a user's face to be kept in a straight, facedown position, thereby assisting in the prevention of a single side of the user's face from becoming overexposed to the sun while the device is in use outdoors. When used for resting in a supine position, the present device helps to relax the neck and back muscles, thereby providing enhanced comfort.

A large embodiment of the resting mattress is generally rectangular and inflatable to a dimension of substantially 7 feet long, 3 feet wide and 6 inches thick.

A small embodiment of the resting mattress is generally rectangular and inflatable to a dimension of substantially 5½ feet long, 2½ feet wide and 3 inches thick.

Other embodiment of the resting mattress provide a variety of shapes and sizes, except that all embodiments of the resting mattress have a facial aperture in the body mat which is cross-shaped adapted to accommodate a user's forehead. This facial aperture combined with the four breathing tubes is critical in its design and essential in its function.

The inflation and deflation valves may be located on the right or left sides or on the front sides of each pillow, but preferably not on the rear sides of each pillow to avoid discomfort or unanticipated opening of the valves.

As such, the general purpose of the improved resting mattress which has all of the advantages of the prior art mentioned heretofore and many novel features that result in an improved resting mattress which is not anticipated, rendered obvious, suggested, or even implied by the prior art, either alone or in combination thereof.

An object of the present resting mattress is to provide a body mat with a facial aperture adapted to rest a users face within, whereby giving maximum comfort when the user is lying in a prone position, simultaneously providing maximum breathing obtained through four breathing tubes located within the bottom of the facial aperture.

Another object of the present resting mattress is to provide head, back and leg support pillows that are inflatable to a desired firmness.

Yet another object of the present resting mattress is to provide head, back and leg support pillows that are adjustable in placement atop the body mat.

Even another object of the present kit is to provide a comfortable, relaxed outdoor or indoor experience.

Still even another object of the present kit is to provide a comfortable, relaxed sleeping experience.

Thus has been broadly outlined the more important features of the improved resting mattress so that the detailed description thereof that follows may be better understood and in order that the present contribution to the art may be better appreciated.

These together with additional objects, features and advantages of the improved resting mattress will be readily apparent to those of ordinary skill in the art upon reading the following detailed description of presently preferred, but nonetheless illustrative, embodiments of the improved resting mattress when taken in conjunction with the accompanying drawings. In this respect, before explaining the current embodiments of the improved resting mattress in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved resting mattress. It is therefore important that the claims be regarded as including such equivalent constructions insofar as they do not depart from the spirit and scope of the present invention.

Objects of the improved resting mattress, along with various novel features that characterize the invention are particularly pointed out in the claims forming a part of this disclosure. For better understanding of the improved resting mattress, its operating advantages and specific objects attained by its uses, refer to the accompanying drawings and description.

DETAILED DESCRIPTION OF THE DRAWINGS

Figure 1:
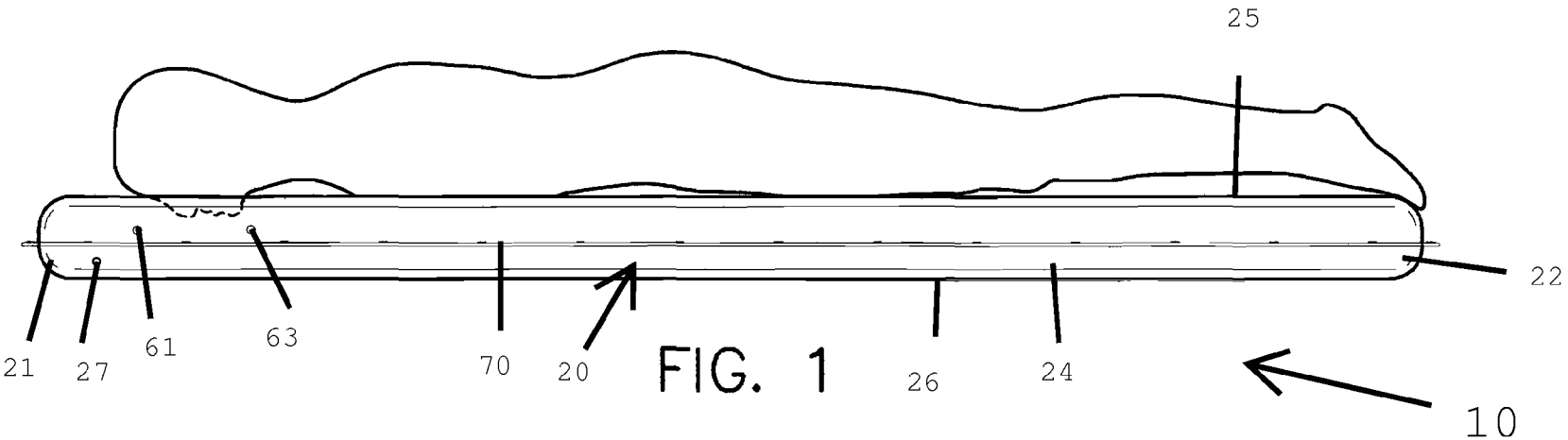
FIG. 1 is a left side elevational view illustrating exemplary use in a prone position.

With reference now to the drawings, and in particular FIGS. 1 through 8 thereof, examples of the employing the principles and concepts of the present resting mattress, generally designated by the reference number 10, will be described.

Referring to FIGS. 1 through 8, the present resting mattress 10 consists of a body mat 20, a head support pillow 30, a lumbar support pillow 40 and a leg support pillow 50. The resting mattress 10 would be constructed of durable vinyl material, airtight nylon, U.V. safe neoprene or semi-rigid gel.

The body mat 20, illustrated in FIGS. 1-8 is generally rectangular having a preferred dimension of substantially 7 feet long, 3 feet wide and 6 inches thick, comprising a front side 21, a back side 22, a right side 23, a left side 24, a topside 25 and a bottom side 26 defining a hollow interior cavity. The body mat 20 further consists of an inflation valve 27 located along the left side 24 within close proximity to the front side 21 adapted to inflate and deflate the hollow interior cavity of the body mat 20.

The topside 25 has a generally cross-shaped facial aperture 28, adapted to accommodate a user's face, descending vertically within the interior of the mat 20. The facial aperture 28 comprises a forward cross extension 28*a*, a rear cross extension 28*b*, a right cross extension 28*c*, a left cross extension 28*d* and a bottom floor 28*e*. The extensions 28*a*, 28*b*, 28*c*, and 28*d* respectively, extend outwardly to their respective sides, for example, the right cross extension 28*c* extends outwardly towards the right side 23 of the mat 20. The facial aperture 28 descends within the interior of the mat 20 to the bottom floor 28*e* located at a depth substantially ¾ of the thickness of the mat 20. The facial aperture 28 further comprises four breathing tubes, a right forward breathing tube 60, a left forward breathing tube 61, a right rear breathing tube 62 and a left rear breathing tube 63. These breathing tubes 60, 61, 62, and 63 run continuously from the interior of the facial aperture 28 through the interior of the mat 20 to their corresponding sides, for example the forward right breathing tube 60 runs through the interior of mat 20 to the right side 23 of mat 20. The forward right and left breathing tubes 60 and 61 respectively, run from the forward cross extension 28*a* to their corresponding sides. The rear right and left breathing tubes 62 and 63 respectively, run from the rear cross extension 28*b* to their corresponding sides. The cross-shape facial aperture 28 and the breathing tubes 60 thru 63 are crucial in their design. The design of the facial aperture 28 was created primarily for proper breathing but also for maximum comfort. When a user lies in a prone position and places his face within the facial aperture 28 the user's nose is centered within the center of the cross-shape facial aperture 28, thus allowing for a non restricted breathing passage. The number and location of the breathing tubes 60-63 allow for maximum airflow. While the user's face rests within the cross-shape facial aperture 28, his forehead comes to rest just above the forward cross extension 28*a*, his chin rests within the rear cross extension 28*b* and his cheek bones rest within the right and left cross extensions 28*c* and 28*d*, respectively, thus obtaining maximum comfort and allowing optimum breathing.

The body mat 20 has a securing flap 70 continuously affixed around the exterior perimeter of the mat 20. The flap 70 is situated generally 3 inches bellow the top side 25 of the body mat 20 along the sides 21, 22, 23 and 24 and protrudes outwardly on a horizontal plain away from the body mat 20. The securing flap 70 has a plurality of securing fasteners 71 adapted to receive a plurality of matting fasteners 72 affixed on the head support pillow 30, the lumbar support pillow 40 and the leg support pillow 50. The location of the securing fasteners 71 allows multiple attachment positions for the head support pillow 30, the lumbar support pillow 40 and the leg support pillow 50. The height of a user and the overall comfort required by the user determine where the positioning of the pillows 30, 40 and 50 are to be located. Theses multiple attachment positions are critical in the overall comfort of a user. The fasteners 71 and 72 have continuing advantages by further allowing a user to secure the pillows 30, 40 and 50 to the body mat 20 whereby helping to prevent pillow slippage or loss do to such extremes as blowing wind or thievery.

Figure 2:
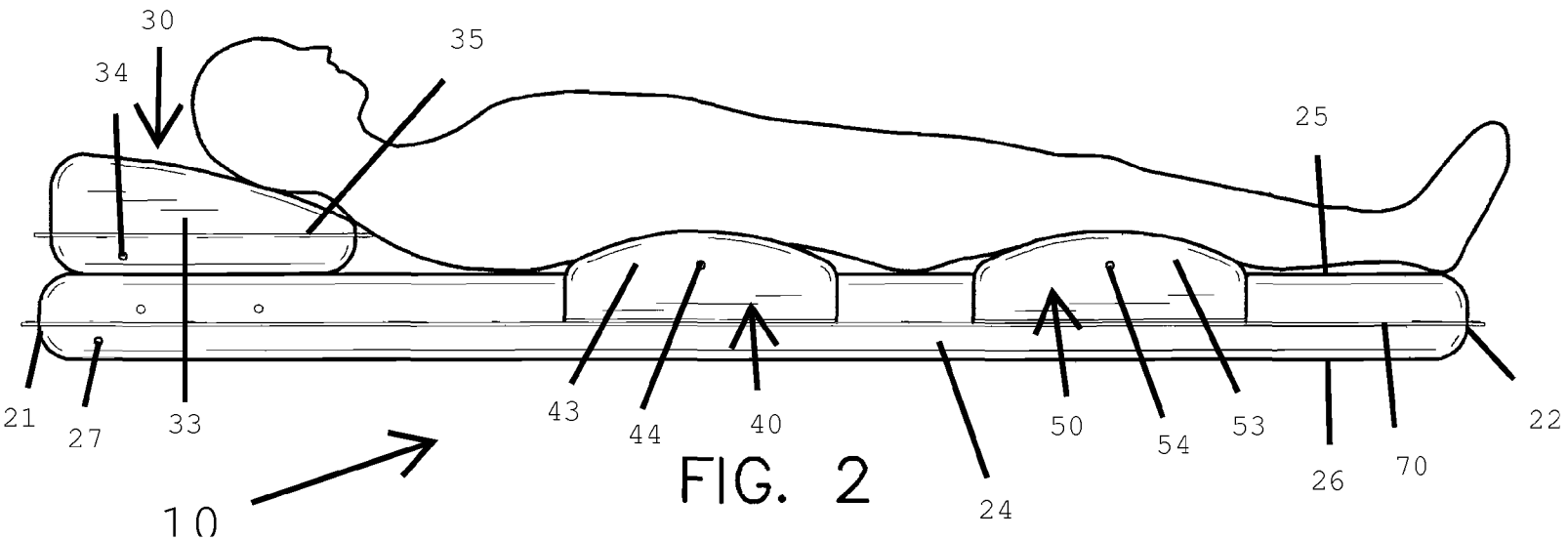
FIG. 2 is a left side elevational view illustrating exemplary use in a supine position utilizing the support pillows.
Figure 3:
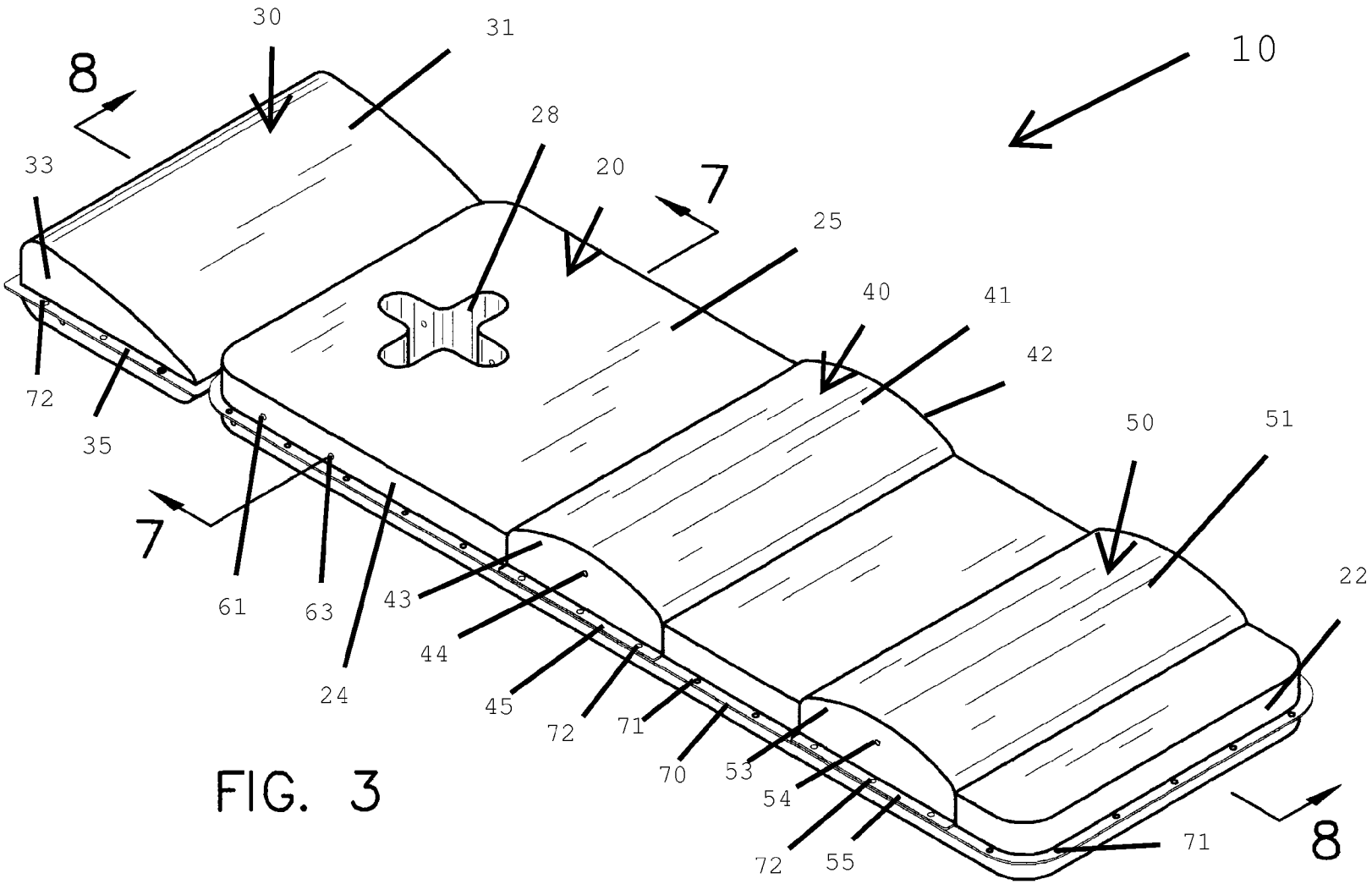
FIG. 3 is a perspective view wherein the lumbar and knee support pillows are engaged while the head support pillow is attached in a stored position.
Figure 5:
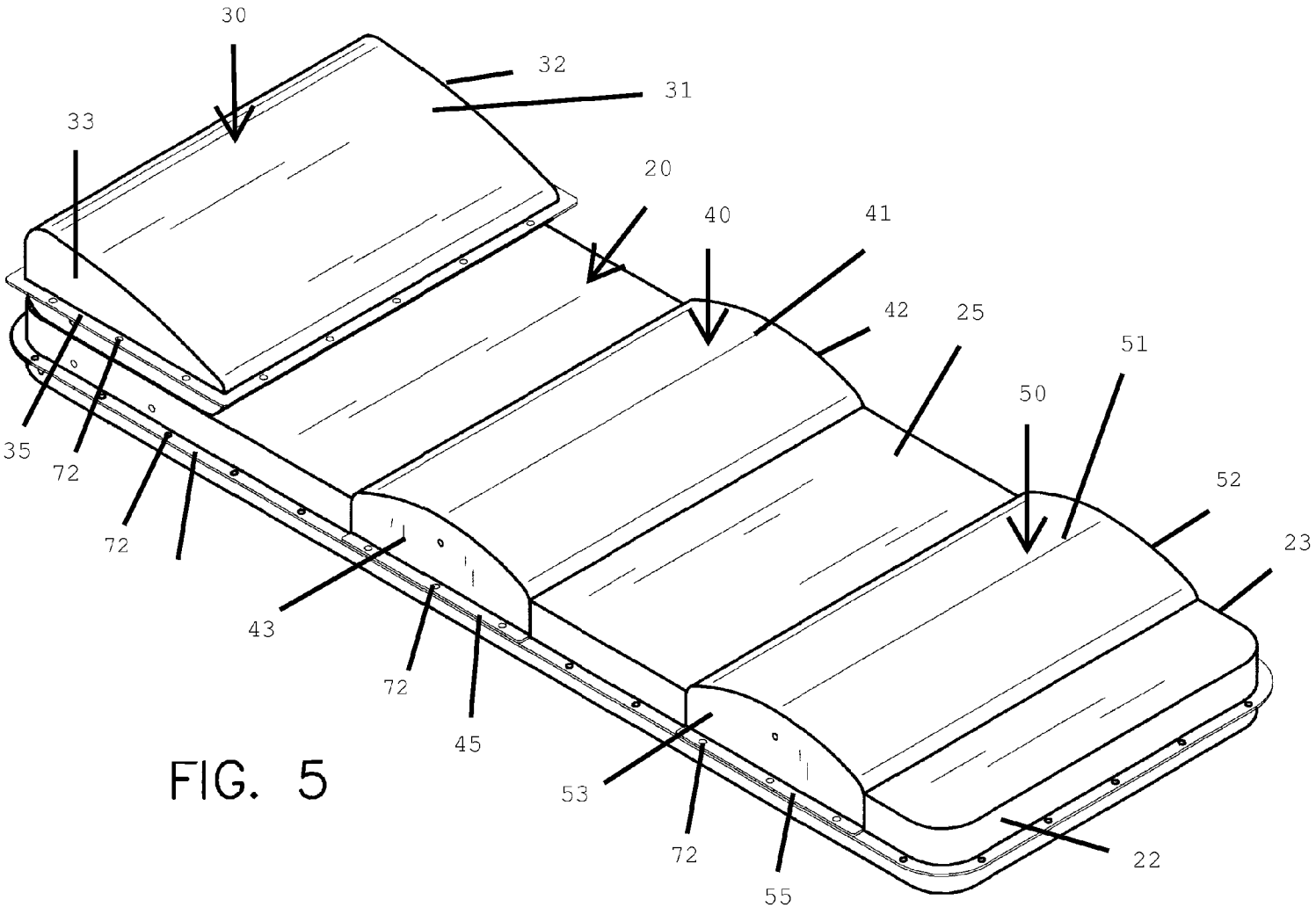
FIG. 5 is a perspective view illustrating the support pillows engaged upon the resting mattress.
Figure 6:
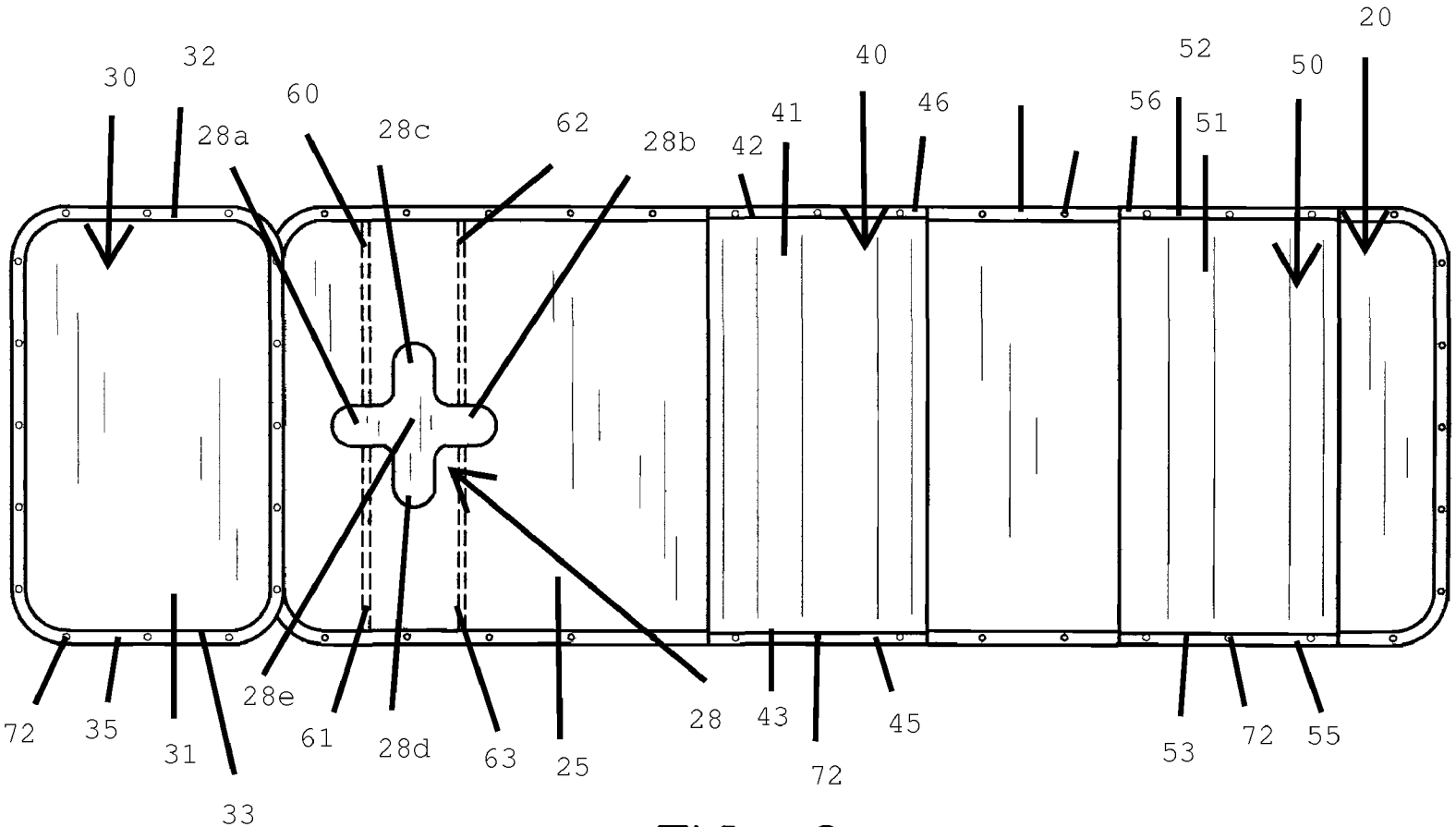
FIG. 6 is a top plan view.
Figure 7:
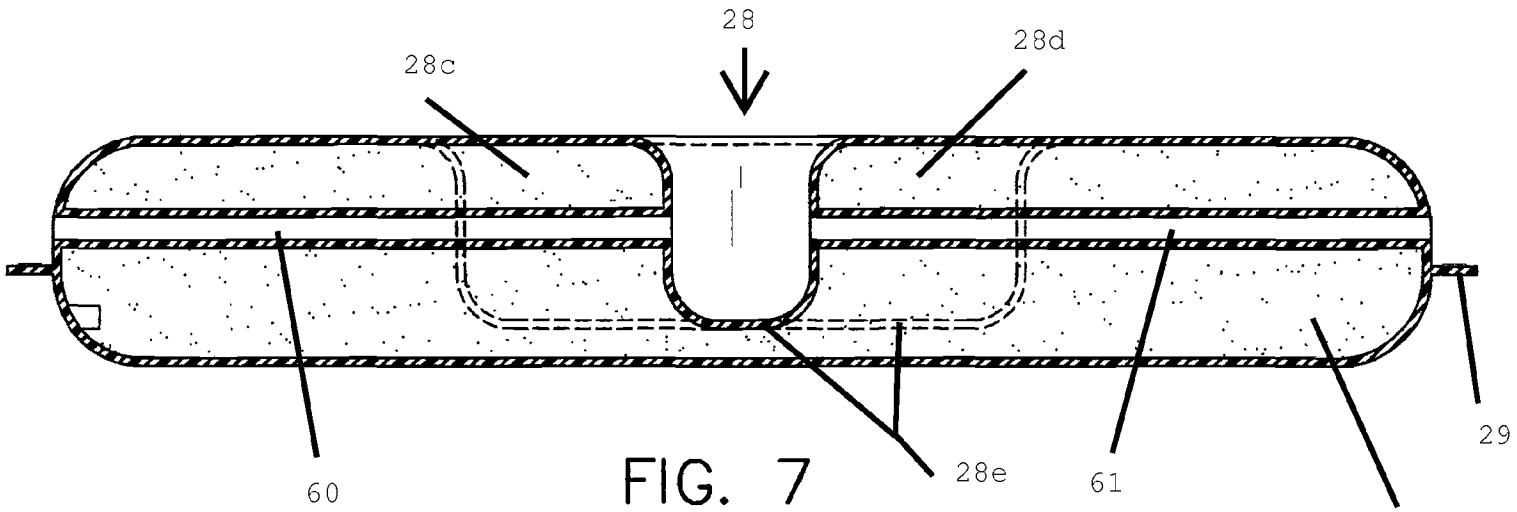
FIG. 7 is a cross sectional view taken along lines 7-7 of FIG. 3.
Figure 8:
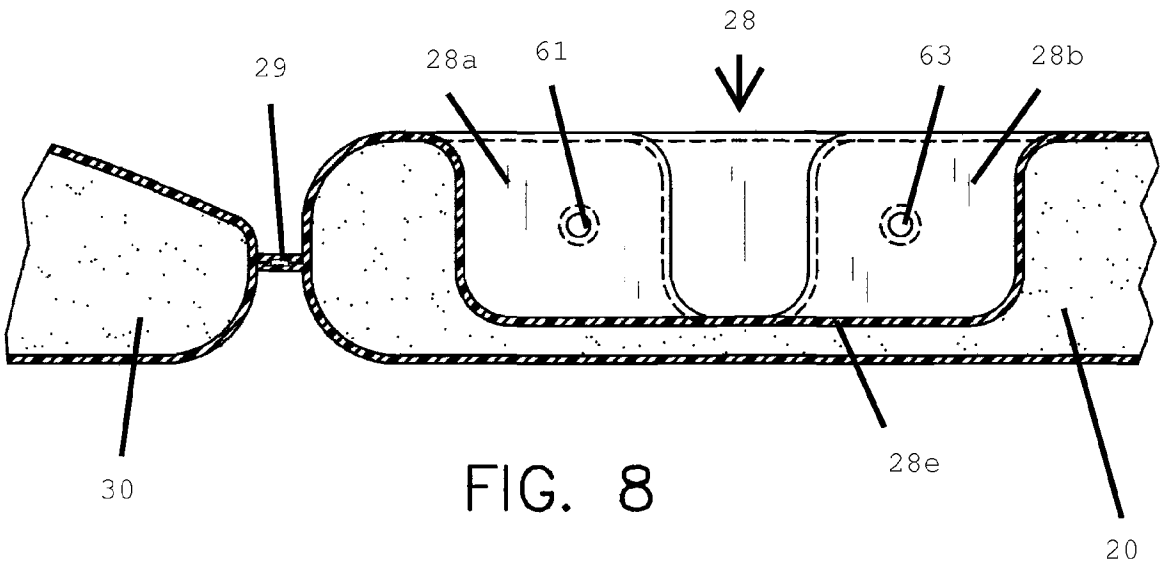
FIG. 8 is a cross sectional view taken along lines 8-8 of FIG. 3.

The head pillow 30 is generally triangular having an exterior wall 31, a right triangular sidewall 32 and a left triangular sidewall 33 defining a hollow interior cavity. The head support pillow 30 consists of a head pillow inflation valve 34 adapted to inflate and deflate the head pillow 30. The head support pillow 30 further consists of a head pillow-securing flap 35 affixed around the head pillow 30, dividing the triangular sidewalls 32 and 33, and the exterior wall 31 through their respective centers. The head pillow-securing flap 35 protrudes outwardly on a horizontal plain and further comprises a plurality of matting fasteners 72 adapted to secure the head support pillow 30 to the body mat 20. FIGS. 3,6 and 8 illustrate the head support pillow 30 attached in a stored position whereas FIGS. 2 and 5 illustrate the head support pillow 30 attached in an "in use" position.

Figure 4:
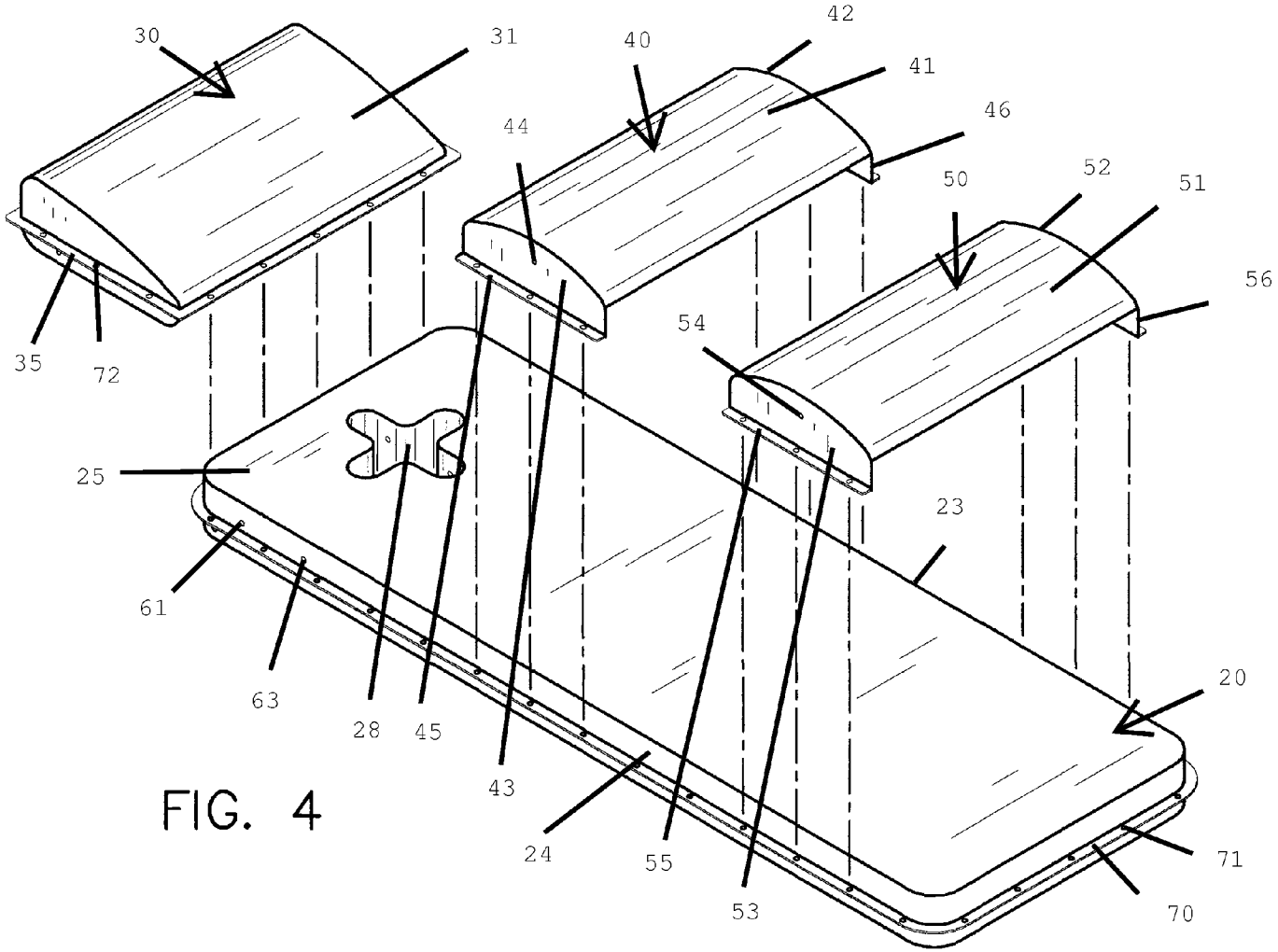
FIG. 4 is a perspective view illustrating the attachment of the head, lumbar and knee support pillows.

The lumbar support pillow 40 is generally quonset-shaped having an exterior wall 41, a right sidewall 42 and a left sidewall 43 defining a hollow interior cavity. The lumbar support pillow 40 consists of a lumbar pillow inflation valve 44 adapted to inflate and deflate the interior cavity of the lumbar pillow 40. The lumbar support pillow 40 further consists of a rectangular shaped lumbar pillow-securing left flap 45 and a rectangular shaped lumbar pillow-securing right strap 46, both the lumbar pillow-securing flap 45 and 46 descend vertically below the lumbar support pillow 40 and have a plurality of matting fasteners 72 affixed along the respective flaps lower edge, as shown in FIG. 4, adapted to removably secure the lumbar support pillow 40 to the body mat 20. In FIGS. 2,3,5 and 6 illustrate an "in use" position.

The leg support pillow 50 is generally quonset-shaped having an exterior wall 51, a right sidewall 52 and a left sidewall 53 defining a hollow interior cavity. The leg support pillow 50 consists of a leg pillow inflation valve 54 adapted to inflate and deflate the interior cavity of the leg pillow 50. The leg support pillow 50 further consists of a rectangular shaped leg pillow-securing left flap 55 and a rectangular shaped leg pillow-securing right strap 56, both the leg pillow-securing flap 55 and 56 descend vertically below the leg support pillow 50 and have a plurality of matting fasteners 72 affixed along the respective flaps lower edge, as shown in FIG. 4, adapted to removably secure the leg support pillow 50 to the body mat 20. In FIGS. 2,3,5 and 6 illustrate an "in use" position.

With respect to the above description then, it is to be realized that the optimum dimensional relationships for the parts of the resting mattress, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A resting mattress comprising in combination:

body mat, a head support pillow, a lumbar support pillow and a leg support pillow further comprising:

a generally rectangular-shaped inflatable body mat adapted to support a human body, said body mat having a front side, a back side, a right side, a left side, a topside and a bottom side define a hollow interior cavity further comprising:

an inflation valve located along said left side of said body mat within close proximity to said front side of said body mat, whereby said inflation valve is adapted to inflate and deflate said body mat, a securing flap continuously affixed around the exterior perimeter of said body mat protruding outwardly away from said body mat on a horizontal plane, said securing flap comprises a plurality of securing fasteners adapted to receive a plurality of matting fasteners, said topside comprises a generally cross-shaped facial aperture, wherein said cross-shaped facial aperture comprises a forward cross extension, a rear cross extension, a right cross extension, a left cross and a bottom floor, said extensions extend outwardly wherein a human face may be comfortably contained, said bottom floor is located at a depth approximately ¾ of the thickness of said body mat, said facial aperture further comprises:

a right forward breathing tube running continuously from said facial aperture thru said interior cavity of said body mat to said right side of said body mat, a left forward breathing tube running continuously from said facial aperture thru said interior cavity of said body mat to said left side of said body mat, a right rear breathing tube running continuously from said facial aperture thru said interior cavity of said body mat to said right side of said body mat, a left rear breathing tube running continuously from said facial aperture thru said interior cavity of said body mat to said left side of said body mat, a generally triangular shaped head support comprising an exterior wall, a right triangular sidewall and a left triangular sidewall defining a hollow interior cavity, said head support pillow further comprises:

a head pillow inflation valve adapted to inflate and deflate said head pillow, a head pillow-securing flap affixed around the exterior perimeter of said head pillow protruding outwardly away from said head pillow on a horizontal plane, said head pillow-securing flap comprises a plurality of matting fasteners which removably affix to said securing fasteners of said body mat, a generally quonset-shaped lumbar support pillow comprising an exterior wall, a right sidewall and a left sidewall which defining a hollow interior cavity, said lumbar support pillow further comprises:

a lumbar pillow inflation valve adapted to inflate and deflate said lumbar support pillow, a rectangular shaped lumbar pillow-securing left flap whereby said left flap descends vertically below said lumbar support pillow and comprises a plurality of matting fasteners which removably affix to said securing fasteners of said body mat, a rectangular shaped lumbar pillow-securing right strap whereby said right strap descends vertically below said lumbar support pillow and comprises a plurality of matting fasteners which removably affix to said securing fasteners of said body mat, a generally quonset-shaped leg support pillow comprising an exterior wall, a right sidewall and a left sidewall which defining a hollow interior cavity, said leg support pillow further comprises:

a leg pillow inflation valve adapted to inflate and deflate said leg support pillow, a rectangular shaped leg pillow-securing left flap whereby said left flap descends vertically below said leg support pillow and comprises a plurality of matting fasteners which removably affix to said securing fasteners of said body mat, a rectangular shaped leg pillow-securing right strap whereby said right strap descends vertically below said leg support pillow and comprises a plurality of matting fasteners which removably affix to said securing fasteners of said body mat.

2. The resting mattress of claim 1 wherein said mattress is constructed from durable heat stamped vinyl.

3. The resting mattress of claim 1 wherein said mattress is constructed from airtight nylon.

4. The resting mattress of claim 1 wherein said mattress is constructed from U.V. safe neoprene.

5. The resting mattress of claim 1 wherein said mattress is constructed semi-rigid gel.

6. The resting mattress of claim 1 wherein said body mat substantially measures 3-6 inches thick, 5½-7 feet in length and 2-3½ feet wide.

7. The resting mattress of claim 1 wherein said resting mattress is equipped with fabric covers securing over said body mat, said head support pillow, said lumbar support pillow and said leg support pillow.

8. The resting mattress of claim 7 wherein said fabric covers are constructed of washable terrycloth material.

9. The resting mattress of claim 7 wherein said fabric covers are constructed of washable microfiber linen.

* * * * *